US011686166B2

(12) United States Patent
Grannes et al.

(10) Patent No.: US 11,686,166 B2
(45) Date of Patent: Jun. 27, 2023

(54) WELL INTERVENTION APPARATUS AND METHOD

(71) Applicant: Coilhose AS, Tananger (NO)

(72) Inventors: Ingvar Grannes, Hafrsfjord (NO); Bjørn Bro Sørensen, Notteroy (NO)

(73) Assignee: Coilhose AS, Tananger (NO)

( * ) Notice: Subject to any disclaimer, the term of this patent is extended or adjusted under 35 U.S.C. 154(b) by 64 days.

(21) Appl. No.: 17/285,268

(22) PCT Filed: Oct. 16, 2019

(86) PCT No.: PCT/EP2019/078123

§ 371 (c)(1),
(2) Date: Apr. 14, 2021

(87) PCT Pub. No.: WO2020/079102

PCT Pub. Date: Apr. 23, 2020

(65) Prior Publication Data

US 2021/0355761 A1 Nov. 18, 2021

(30) Foreign Application Priority Data

Oct. 16, 2018 (GB) ..... 1816857

(51) Int. Cl.
*E21B 17/02* (2006.01)
*E21B 17/20* (2006.01)
*H01B 7/04* (2006.01)

(52) U.S. Cl.
CPC ..... *E21B 17/203* (2013.01); *E21B 17/02* (2013.01); *E21B 17/023* (2013.01); *E21B 17/206* (2013.01); *H01B 7/046* (2013.01)

(58) Field of Classification Search
CPC ..... E21B 17/02; E21B 17/023; E21B 17/203; E21B 17/206; H01B 7/046
See application file for complete search history.

(56) References Cited

U.S. PATENT DOCUMENTS

| | | | | |
|---|---|---|---|---|
| 3,422,914 A | | 1/1969 | Pomeroy | |
| 3,866,679 A | | 2/1975 | Laky | |
| 4,941,349 A | * | 7/1990 | Walkow | G01V 1/52 439/589 |
| 5,146,982 A | * | 9/1992 | Dinkins | H01B 7/16 166/65.1 |
| 5,178,223 A | | 1/1993 | Smet | |
| 5,244,046 A | * | 9/1993 | Council | E21B 19/22 166/380 |

(Continued)

FOREIGN PATENT DOCUMENTS

GB 1184970 A 3/1970

*Primary Examiner* — D. Andrews
(74) *Attorney, Agent, or Firm* — Getz Balich LLC

(57) ABSTRACT

Well intervention apparatus is provided, the well intervention apparatus including a flexible hose to be lowered into a well, a stuffing seal which engages around the hose during lowering, at least one tool provided at a downhole end portion of the hose, and a plurality of individual tubes extending along an inside region of the hose and connecting to the at least one tool, each individual tube providing a fluid path for fluid communication between outside of the well and the at least one tool inside the well, and each individual tube being laterally supported in said inside region such that its lateral movement is restricted.

19 Claims, 10 Drawing Sheets

SECTION A-A

(56) References Cited

U.S. PATENT DOCUMENTS

| | | | | |
|---|---|---|---|---|
| 5,269,377 | A * | 12/1993 | Martin | E21B 17/1042 166/385 |
| 6,305,476 | B1 * | 10/2001 | Knight | E21B 17/0423 166/385 |
| 8,925,627 | B2 * | 1/2015 | Tupper | E21B 36/04 166/77.2 |
| 2011/0127029 | A1 | 6/2011 | Ganelin | |
| 2011/0240312 | A1 * | 10/2011 | Varkey | H02G 9/06 166/66.4 |
| 2016/0047210 | A1 | 2/2016 | Pinkston | |
| 2016/0258231 | A1 | 9/2016 | Naumann | |

* cited by examiner

SECTION D-D

SECTION A-A

SECTION B-B

SECTION C-C

SECTION A-A

DETAIL B

WELL INTERVENTION APPARATUS AND METHOD

This application claims priority to PCT Patent Appln. No. PCT/EP2019/078123 filed Oct. 16, 2019, which claims priority to GB Patent Appln. No. 1816857.5 filed Oct. 16, 2018, which are herein incorporated by reference.

BACKGROUND OF THE INVENTION

1. Technical Field

The invention relates to well intervention apparatus and to a method of well intervention. The intervention may be carried out on land or sea based oil or gas rigs.

2. Background Information

Well interventions are remedial operations that are performed on oil or gas producing wells with the intention of restoring or increasing production. There are three main types of well intervention, namely wireline intervention, coiled tubing intervention and hydraulic work over intervention. The wireline technique involves running a cable into the well from the surface, such as from a platform deck or a vessel. An intervention tool string is attached to the wire and the weight of the tool string, plus additional weighting if necessary, is used to run the wire into the well, where the tool string performs a maintenance or service operation. Wireline intervention is carried out in wells under pressure. The wire is supplied from a drum and passes via two sheaves to a stuffing box which is exposed to well pressure on its well side. Wireline intervention is a light well intervention process.

Coiled tubing intervention is a medium well intervention process, requiring the use of a larger space or deck. It has the advantage over wireline intervention that it provides a hydraulic communication path to the well, but uses heavier and more costly equipment and requires more personnel.

The coiled tubing is a length of continuous tubing supplied on a reel. The outside diameter of the tubing ranges from small sizes of about 3 cm so-called capillary tubing) up to 8 or 9 cm. The tubing is fed from the reel upwardly to a tubing guide, known as a goose neck, and from there via an injector downwardly towards the well.

Coiled tubing is usually manufactured from steel alloy and is much heavier and larger than wireline. An injector head is required to push or "snub" the tubing into the well, and to pull it out of the well when an intervention job has been completed.

Coiled tubing has been used to provide a pathway into a well for both fluid and electrical communication. An electrical cable is loosely carried inside the coiled tubing and the remaining space inside the coiled tubing is used to provide fluid communication. The inventors have recognized that during feeding of the coiled tubing from the reel, the electrical cable may move relative to the inside wall of the coiled tubing, causing frictional wear and tear to the electrical cable. Moreover, given that the coiled tubing may be lowered to depths of hundreds or thousands of meters, relative movement may arise from different elongations of the electrical cable and the coiled tubing under their own weight, again giving rise to wear and tear.

SUMMARY OF THE INVENTION

Viewed from a first aspect the invention provides well intervention apparatus comprising a flexible hose to be lowered into a well, a stuffing seal which engages around the hose during lowering, at least one tool provided at a downhole end portion of the hose, and a plurality of individual tubes extending along an inside region of the hose and connecting to the at least one tool, each individual tube providing a fluid path for fluid communication between outside of the well and the at least one tool inside the well, and each individual tube being laterally supported in said inside region such that its lateral movement is restricted.

Viewed from another aspect the invention provides a method of well intervention comprising lowering a flexible hose into a well through a stuffing seal which engages around the hose during lowering, at least one tool being provided at a downhole end portion of the hose, and a plurality of individual tubes extending along an inside region of the hose and connecting to the at least one tool, each individual tube providing a fluid path for fluid communication between outside of the well and the at least one tool inside the well, and each individual tube being laterally supported in said inside region such that its lateral movement is restricted.

By providing laterally supported individual tubes, wear of those tubes during lowering of the hose into the well may be minimized.

The well intervention method may involve carrying out a plurality of operations using the at least one tool. The plurality of operations may include well logging, jetting, drilling or cutting. The plurality of operations can be carried out without having to change from one intervention hose to another, by using the plurality of individual tubes for fluid communication. Thus the apparatus and method can involve the use of a single intervention hose to perform plural intervention operations. The intervention hose may be lowered just once to perform a plurality of operations, and then raised. Even if it is necessary to lower and raise the intervention hose between operations, the rest of the equipment for deploying the intervention hose, such as the stuffing seal and so forth, need not be changed. This can streamline operations and save costs.

At least two, or at least three, or at least four, or at least five, or at least six individual tubes for fluid communication may be provided. Thus one or more individual tubes may be used for an operation such as jetting or cleaning, whilst one or more other individual tubes may be used for another operation such as supplying hydraulic fluid to a hydraulic pump or motor to effect a cutting or drilling operation.

By providing at least three individual tubes, two of them may be used for a particular operation, for example one for fluid to advance downhole and the other for return of fluid, and then a third individual tube is available for use in the event of a problem arising with the first or second tube. Therefore, it would not be necessary to scrap the flexible hose in the event of the first or second tube becoming unusable.

A first individual tube may have a different internal diameter from a second individual tube. A first individual tube may have a smaller internal diameter than the internal diameter of a second individual tube. For example, the first individual tube may be used for supplying hydraulic pressure to operate or control a tool, and the second individual tube may be used for supplying fluid which is discharged into the well. The larger diameter is beneficial in order to minimize flow resistance.

By providing individual tubes for fluid communication, a situation where two separate fluid paths share a common wall can be avoided. Therefore, the effect of pressure inside one individual tube on another individual tube may be minimized.

In addition to individual tubes being provided for fluid communication, one or more individual tubes may also be provided for electrical communication. Such an individual tube may take the form of an electrical cable.

In addition to individual tubes being provided for fluid communication, one or more individual tubes may also be provided for optical communication. Such an individual tube may take the form of a fiber-optic cable.

An embodiment may include individual tubes for fluid communication, electrical communication, and optical communication.

The individual tubes may be sufficiently closely arranged to provide lateral support to each other within the confines of the hose. A flexible material in the inside region may provide said lateral support to the individual tubes. The flexible material may comprise filler members, such as filler tubes or solid tubes. The flexible material may comprise material which is injected into the hose and allowed to set.

The inside region of the hose may be considered as the entire region within an outer sheath of the hose. All of this region may be occupied by individual tubes and other solid material. The other material may comprise flexible material and/or weight bearing material such as steel wires. In these arrangements, no part of the inside region is left as space within the outer sheath. By avoiding such space, entry of fluids, such as liquids or gases, to the inside region (other than intentionally to the insides of the individual tubes) can be avoided or minimized.

The individual tubes may be longitudinally supported in the inside region of the hose such that their longitudinal movement is restricted. This can minimize differential stretching of the individual tubes which may otherwise cause them to wear or break. It will be appreciated that the hose may be hundreds or thousands of meters in length, so that significant tensile forces are involved. The lateral and longitudinal support to the individual tubes may be provided by the same means, which may be a sufficiently close arrangement of the individual tubes to provide lateral and longitudinal support to each other within the confines of the hose, or the means may include flexible material in the inside region to provide lateral and longitudinal support to the individual tubes.

The flexible hose may be of a type usually used as a subsea umbilical. Subsea umbilicals are used for example to operate a subsea blow-out preventer from the surface. The inventors have realized that a subsea umbilical can be lowered into a well to provide plural lines of communication, including fluid communication and preferably also electrical or optical or a combination thereof, between outside of the well and inside the well. Where necessary, a subsea umbilical can be specified to a manufacturer so that it will tolerate the environment inside a well, for example to tolerate heat, pressure, exposure to natural or injected well fluids, exposure to chemicals, and so forth.

The flexible hose may typically have an outside diameter of 20-150 mm, preferably 20-120 mm or 40-120 mm, for example having an outside diameter of 40 mm, 50 mm, 60 mm, 70 mm, 80 mm, 90 mm or 100 mm.

A seal may be provided around the downhole end portion of the hose. Such a seal can engage with an outer sheath of the hose. One or more O-rings may serve as such a seal. A sealing mechanism may be provided to compress the seal between the outside of the hose and a body extending circumferentially around the hose.

A bottom hole assembly may be provided at the downhole end portion of the hose, the bottom hole assembly having said seal around the downhole end portion of the hose. A termination assembly may be provided. The hose may extend into a body of the termination assembly, and the seal may be provided in a cavity in the body. A sealing mechanism may be provided at least partly in the cavity to compress the seal between the outside of the hose and the body extending circumferentially around the hose. The sealing mechanism may comprise at least one axially movable member, configured so that when the axially movable member moves axially towards the seal, the seal is caused to engage in sealing manner between the outside of the hose and the body.

The inside region of the hose may be open to a chamber in the bottom hole assembly, the chamber being sealed from the outside. Thus the inside region of the hose may be isolated from well pressure. The chamber may be formed in the termination assembly. The chamber may be sealed from above by the seal around the intervention hose. The chamber may be sealed from below by a second seal. The second seal made comprise one or more O-rings.

A connector may be provided in the chamber for connecting a continuation tube to one of the individual tubes, the continuation tube extending to the at least one tool. The connector may be a twin ferrule connector assembly.

The bottom hole assembly may comprise a termination assembly for the intervention hose, the termination assembly being removably connected to the at least one tool.

The well intervention apparatus may comprise at least two tools at the downhole end portion of the hose, a said individual tube providing a fluid path for fluid communication between outside of the well and a first one of said at least two tools, and a said individual tube providing for fluid communication between outside of the well and a second one of said at least two tools. The individual tube for the first tool may connect directly to that tool or it may connect via a continuation fluid conduit. The individual tube for the second tool may connect directly to that tool or it may connect via a continuation fluid conduit.

The well intervention apparatus may comprise at least one individual tube in the form of an electrical cable. The well intervention apparatus may comprise at least one individual tube in the form of a fiber-optic cable.

In many intervention operations, it is expected that the well will be a non-subsea well. By this it is meant that access to the well will not be underwater. Thus, in a preferred well intervention apparatus and method, the stuffing seal will be provided not underwater. The wellhead may be in air, not underwater. In this specification non-subsea wells include an offshore well, with a wellhead which is on a deck (i.e. "dry"), or an onshore well, again with a wellhead which is "dry".

BRIEF DESCRIPTION OF THE DRAWINGS

Certain preferred embodiments of the invention will now be described, by way of example only, and with reference to the accompanying drawings, in which.

The drawings are schematic in nature and where cross-sections are shown some features are omitted for simplicity of explanation.

DETAILED DESCRIPTION OF THE INVENTION

Figure 1:
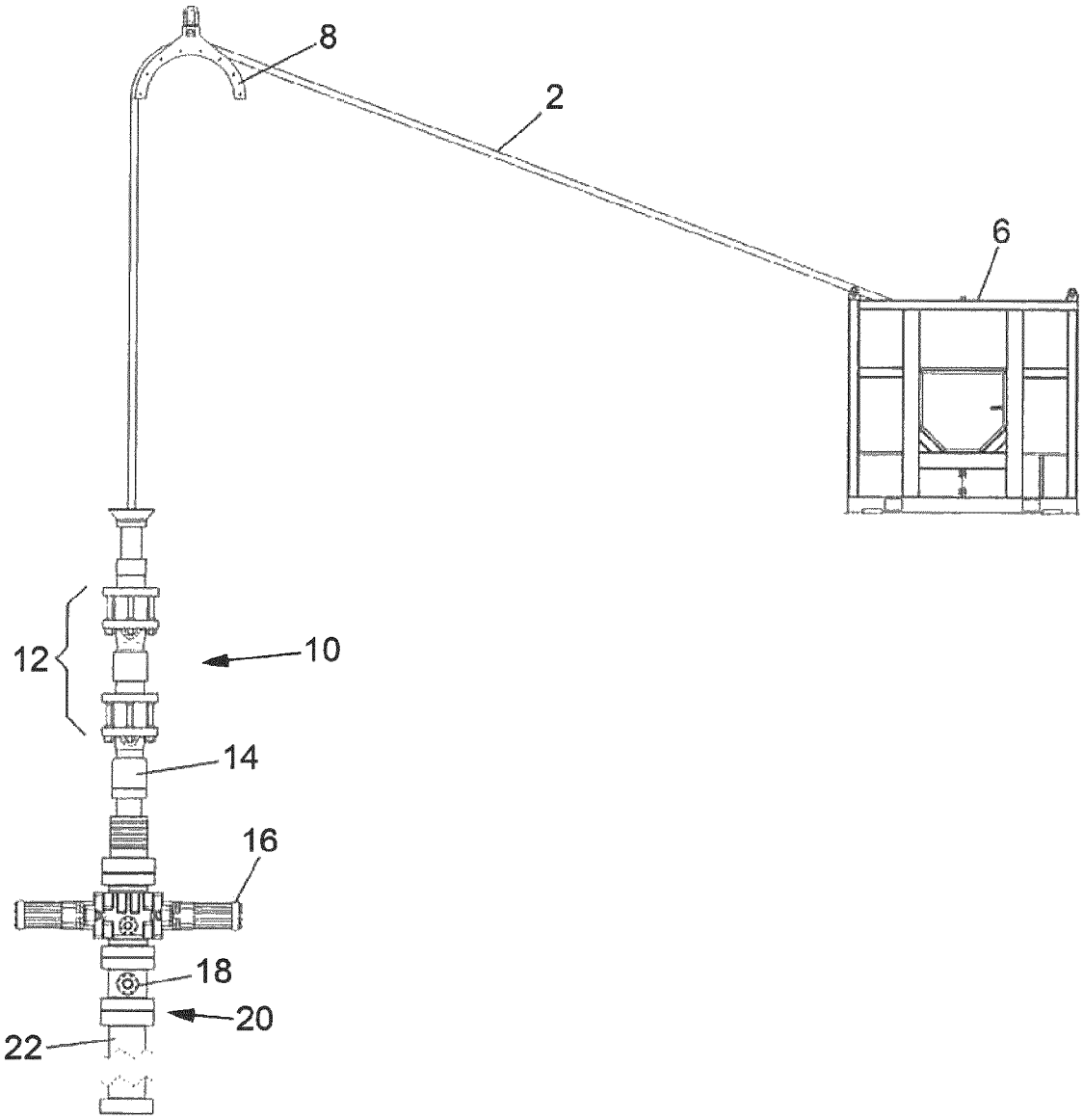
FIG. 1 is an overview of an intervention system according to the invention, in a side elevation view.
Figure 2:
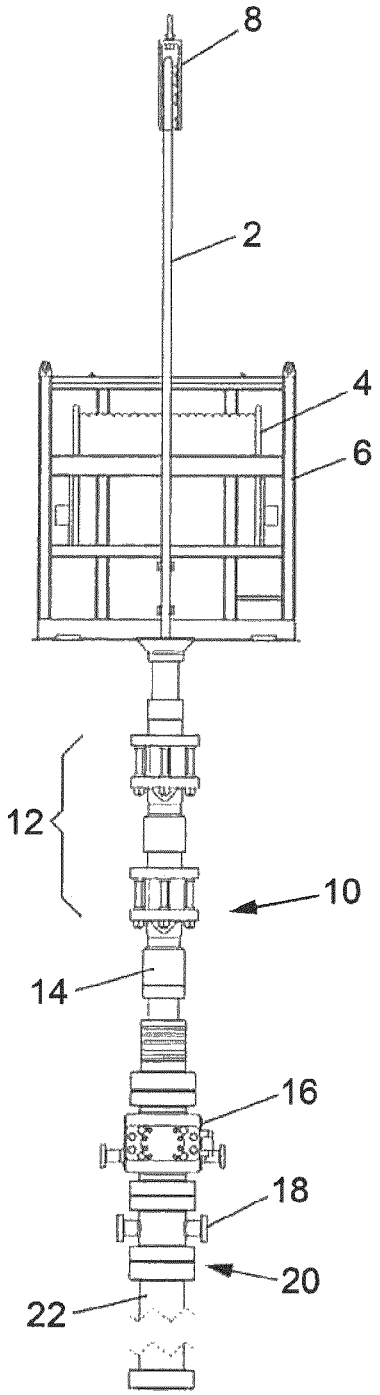
FIG. 2 is a front elevation view of the system of FIG. 1.
Figure 3:
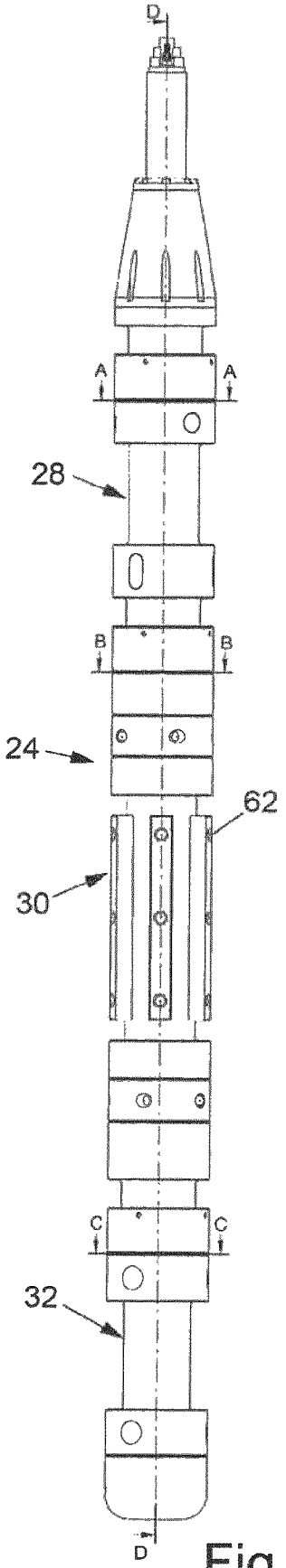
FIG. 3 is an elevation view of a bottom hole assembly on the end of an intervention hose.

FIG. 1 shows an intervention set up for a well head on a fixed offshore platform or a land well. The well head is thus "dry" in the sense that it is not underwater and is either above the sea surface or is on land.

An intervention hose 2 is provided on a drum 4 supported in a drum housing 6 which sits on the ground or a deck. The drum 4 includes a pulling mechanism, which can also provide a back tension function. The pulling mechanism may be of the type used for wire line drums. The drum 4 also includes a spooling mechanism, as is known for coiled tubing intervention reels.

The intervention hose 2 extends from the drum to a guiding sheave (not shown) rotatably supported on a guiding sheave holder 8 (partially shown), where it is deviated from an upwardly inclined direction to a vertical downward direction, towards a well. The intervention hose 2 extends downwardly from the guiding sheave into an intervention stack 10, which consists of a dual stuffing box 12 and a lubricator 14. The dual stuffing box 12 comprises a plurality of stuffing seals which engage in sealing manner around the intervention hose, to allow the hose to be lowered or raised whilst providing an environment below the dual stuffing box 12 which is sealed from the outside.

A blow-out preventer (BOP) 16 is provided below the intervention stack 10, and a shear seal 18 is provided below the BOP. In this embodiment, in which the intervention is being performed on a subsea well, a flanged connection 20 to a riser 22 is provided below the shear seal 18, and the riser 22 extends vertically downwardly from the surface through the sea to a wellhead (not shown). In an alternative embodiment, where the intervention is being performed on a land-based well, the flanged connection 20 is made directly to a wellhead.

FIGS. 3-8 show a bottom hole assembly 24 provided at a downhole end portion of the intervention hose 2. The bottom hole assembly 24 comprises a termination assembly 26 for the intervention hose 2, and a plurality of tools consisting of a well logging tool 28, a high-pressure jetting tool 30, and a drilling tool 32.

Figure 10:
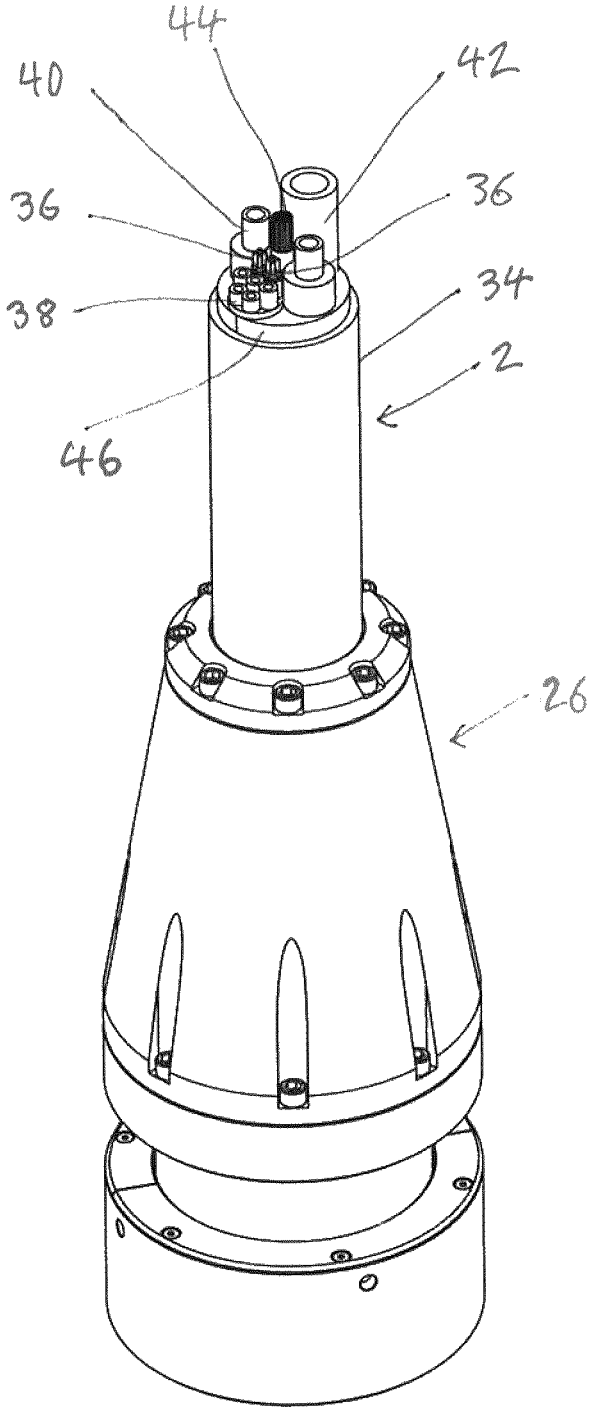
FIG. 10 is a perspective view of a termination assembly.

The intervention hose 2 comprises a plurality of individual tubes contained in an outer sheath 34, as can be seen in FIG. 10. The individual tubes consist of a pair of electric cables 36, five small-diameter fluid lines 38, a pair of intermediate diameter fluid lines 40, and a large diameter fluid line 42. A central load-bearing metal cable 44 is also provided in the outer sheath 34. Fill material 46 occupies the rest of the inside region of the outer sheath 34, and provides lateral support to the individual tubes to restrict their lateral movement. In an alternative embodiment, the tubes themselves may be sufficiently closely packed such that they are laterally supported to have their lateral movement restricted.

The pair of electric cables 36 communicate with the well logging tool 28, the five small-diameter fluid lines 38 communicate with the jetting tool 30, and the intermediate diameter fluid lines 40 and the large diameter fluid line 42 communicate with the drilling tool 32. This arrangement will be further described with reference to FIGS. 3-8.

A chamber 46 is provided in the termination assembly 26, and in this chamber the individual tubes emerge from the outer sheath 34 of the intervention hose 2. At the upper end of the chamber 46 a sealing arrangement is provided on the outer sheath in order to seal the chamber from the outside. At the lower end of the chamber 46 another sealing arrangement is provided to seal the chamber from the outside. Further details of the sealing arrangements are described later.

Figure 5:
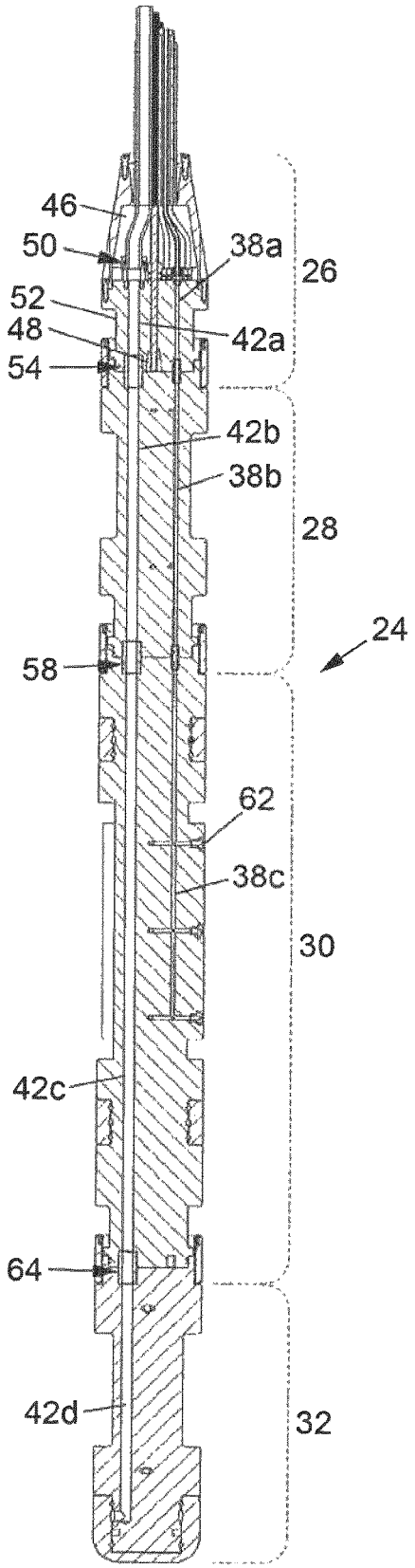
FIG. 5 is a vertical sectional view on lines D-D of FIG. 3.
Figure 6:
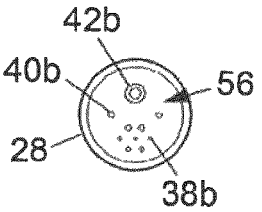
FIG. 6 is a horizontal sectional view on lines A-A of FIG. 3.
Figure 7:
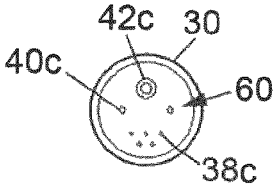
FIG. 7 is a horizontal sectional view on lines B-B of FIG. 3.
Figure 8:
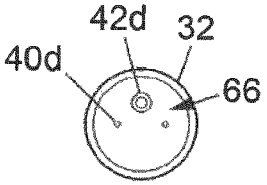
FIG. 8 is a horizontal sectional view on lines C-C of FIG. 3.
Figure 4:
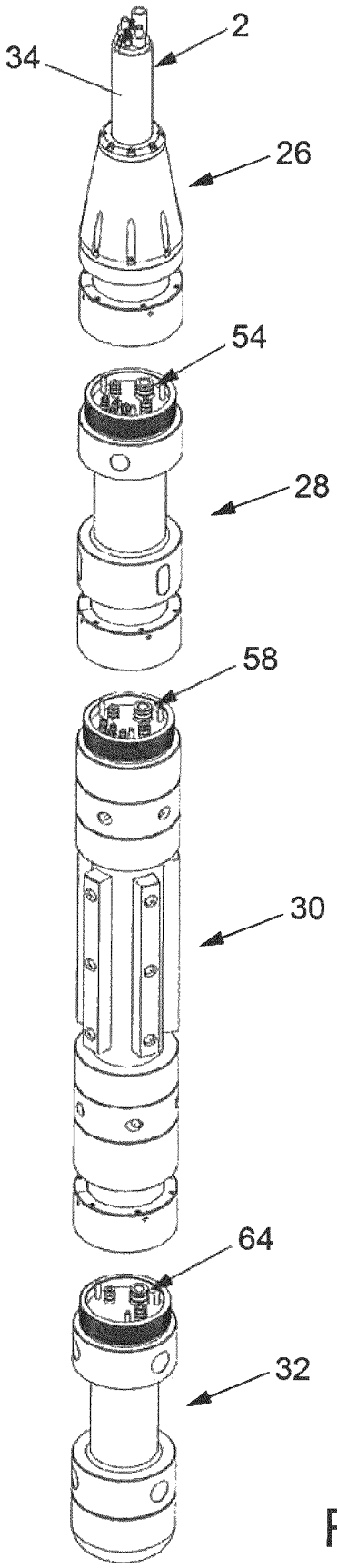
FIG. 4 is a perspective view of the bottom hole assembly with the tools shown separated.
Figure 12:
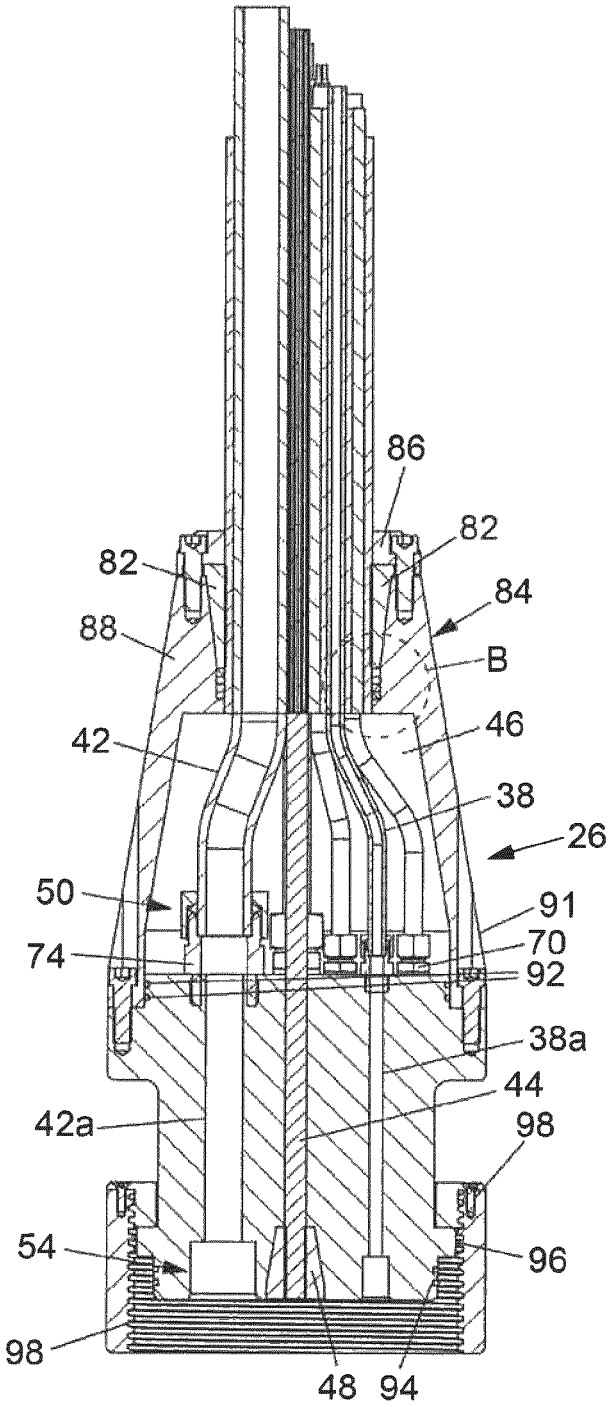
FIG. 12 is a vertical sectional view on lines A-A of FIG. 11.

The metal cable 44 also emerges from the outer sheath 34 of the intervention hose 2 into the chamber 46 and is secured at its lower end to the termination assembly 26 by an anchor 48. The individual tubes extend downwardly through the chamber 46 to a set of twin ferrule connector assemblies 50 (see FIG. 12). They connect via these assemblies to corresponding individual tubes in a feed-through receptacle 52 in the lower part of the termination assembly 26. The individual tubes in the feed-through receptacle 52 provide continuations of the individual tubes 36, 38, 40 and 42 respectively of the intervention hose, so as to form continuation individual tubes in the feed-through receptacle 52. FIGS. 5 and 12 show continuation individual tubes 38*a* and 42*a* in the feed-through receptacle 52 for the individual tubes 38 and 42 of the intervention hose (the continuation individual tubes in the feed-through receptacle 52 for individual tubes 36 and 40 are not shown). The continuation individual tubes in the feed-through receptacle 52 connect via another set of twin ferrule connector assemblies 54 at the interface between the termination assembly 26 and the well logging tool 28, to a set 56 of individual tubes in the well logging tool 28, as indicated by the section A-A shown in FIG. 6. The set 56 of individual tubes thus comprises continuation individual tubes 36*b*, 38*b*, 40*b* and 42*b* respectively of the individual tubes 36, 38, 40 and 42 contained in the intervention hose 2. The continuation individual tubes 36*b* corresponding to the pair of electric cables 36 terminate within the well logging tool 28, thereby providing electrical communication between that tool and the surface, via the intervention hose 2 extending to the surface.

The other continuation individual tubes of the set 56 in the well logging tool 28, namely continuation individual tubes 38*b*, 40*b* and 42*b*, pass through the well logging tool 28 to another set of twin ferrule connector assemblies 58 at the interface between the well logging tool 28 and the high-pressure jetting tool 30. The twin ferrule connector assemblies 58 form a connection with a set 60 of individual tubes in the jetting tool 30, these individual tubes consisting of continuation individual tubes 38*c*, 40*c* and 42*c*, which provide further continuations respectively of the individual tubes 38, 40 and 42 contained in the intervention hose 2. The continuation individual tubes 38*c*, 40*c* and 42*c* are shown in the section 8-8 of FIG. 7, The continuation individual tubes 38*c* corresponding to the five small-diameter fluid lines 38 of the intervention hose 2 terminate at the jetting tool 30 via jetting nozzles 62. Thus, fluid communication is provided between the jetting tool 30 and the surface, via the intervention hose 2 extending to the surface.

The other continuation individual tubes of the set 60 in the jetting tool 30, namely tubes 40*c* and 42*c*, pass downwardly along the length of the tool to a further set of twin ferrule connector assemblies 64 at the interface between the jetting tool 30 and the drilling tool 32. The twin ferrule connector assemblies 64 form a connection with a set 66 of individual tubes in the drilling tool 32, this set 66 consisting of continuation individual tubes 40*d* and 42*d*, which provide further continuations respectively of the individual tubes 40 and 42 contained in the intervention hose 2. The continuation individual tubes 40*d* and 42*d* are shown in the section C-C of FIG. 8. The continuation individual tubes 40*d* and 42*d* terminate in the drilling tool 32, thereby providing fluid communication between the drilling tool 32 and the surface, via the intervention hose 2 extending to the surface. In this embodiment, the continuation individual tubes 40*d* supply hydraulic fluid under pressure, and the continuation individual tube 42*d* provides a drain line.

The drilling tool 32 is removably connected to the jetting tool 30. If it is desired to modify the bottom hole assembly 24 by omission of the drilling tool 32, it can be disconnected and the continuation individual tubes 40*c* and 42*c* could be terminated by appropriate plugs, either at the interface between the jetting tool 30 and the drilling tool 32, or the interface between the well logging tool 28 and the jetting tool 30.

Similarly, the jetting tool 30 is removably connected to the well logging tool 28. Therefore, if it is desired to modify the bottom hole assembly 24 by omission of the jetting tool 30 and the drilling tool 32, the jetting tool 30 may be disconnected from the well logging tool 28. The continuation individual tubes 38*b*, 40*b* and 42*b* could be terminated by appropriate plugs, either at the interface between the well logging tool 28 and the jetting tool 30, or the interface between the termination assembly 26 and the well logging tool 28.

In this embodiment twin ferrule connector assemblies are provided for all the individual tubes in the termination assembly 26, at the interface between the termination assembly 26 and the well logging tool 28, at the interface between the well logging tool 28 and the jetting tool 30, and at the interface between the jetting tool 30 and the drilling tool 32. However, in alternative embodiments an individual tube may extend continuously from the intervention hose 2 through the termination assembly 26 to a tool, without having to form a connection via one or more twin ferrule connector assemblies.

Figure 9:
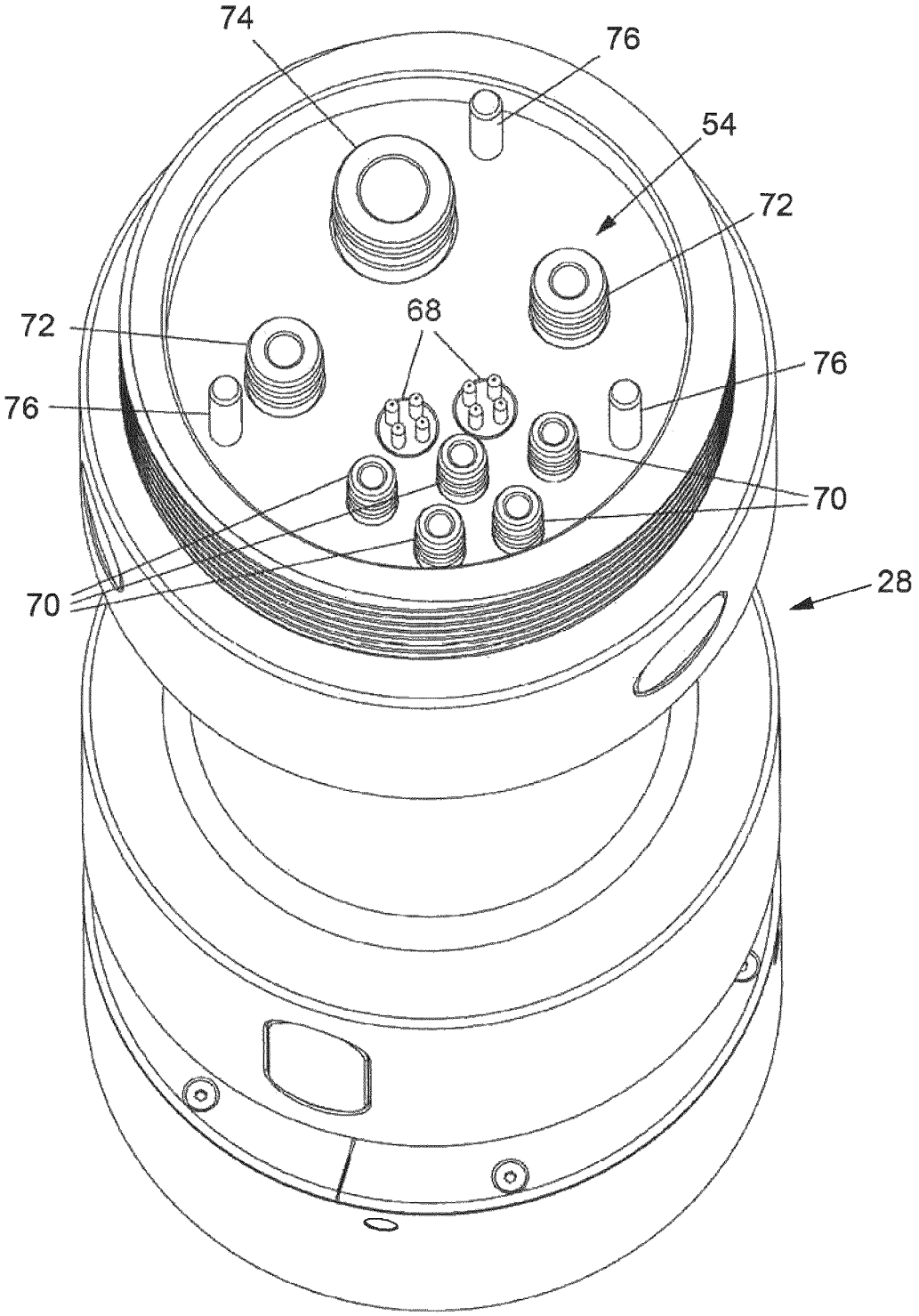
FIG. 9 is a perspective view of a well logging tool.

FIG. 9 shows the lower portions of the set of twin ferrule connector assemblies 54 at the interface between the termination assembly 26 and the well logging tool 28. A pair of lower portions 68 belongs to the connector assemblies which connect the individual tubes in the feed-through receptacle 52 which correspond to the individual tubes 36 in the intervention hose 2 to the individual tubes 36*b* in the well logging tool 28. Five lower portions 70 belong to the connector assemblies which connected the individual tubes 38*a* in the feed-through receptacle 52 which correspond to the individual tubes 38 in the intervention hose 2 to the individual tubes 38*b* in the well logging tool 28. A pair of lower portions 72 belongs to the connector assemblies which connect the individual tubes in the feed-through receptacle 52 which correspond to the individual tubes 40 in the intervention hose 2 to the individual tubes 40*b* in the well logging tool 28. A lower portion 74 belongs to the connector assembly which connects the individual tube 42*a* in the feed-through receptacle 52 which corresponds to the individual tube 42 in the intervention hose 2 to the individual tube 42*b* in the well logging tool 28. Steering pins 76 project upwardly at the upper face of the well logging tool 28 to assist alignment when it is connected to the termination assembly 26.

Figure 11:
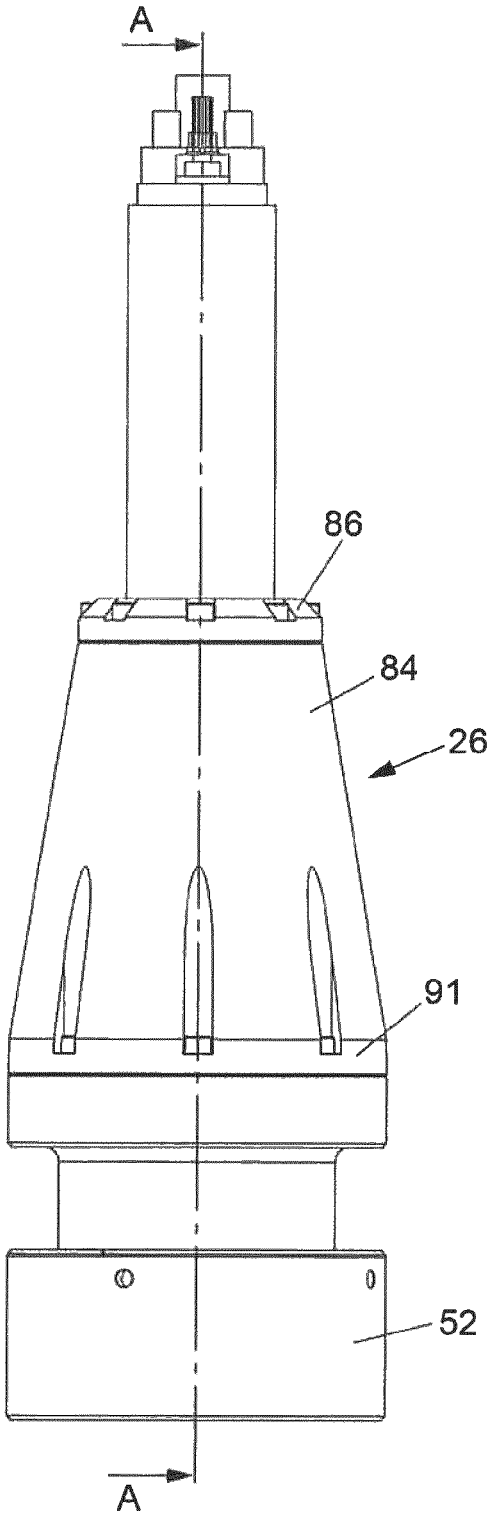
FIG. 11 is an elevation view of the termination assembly.
Figure 13:
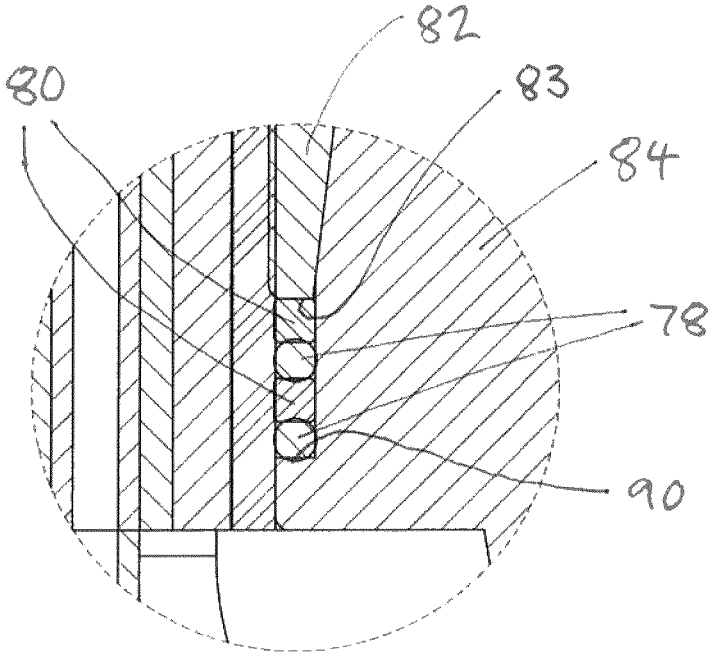
FIG. 13 shows detail "B" indicated in FIG. 12.

FIGS. 11-13 show further details of the termination assembly 26. A generally conical upper sleeve 84 is bolted to the feed-through receptacle 52 and defines internally the chamber 46. The upper sleeve 84 has an upper portion 88 which generally surrounds the outer sheath 34 of the intervention hose 2 and is closed by a closing plate 86 which is bolted to the upper portion. The closing plate 86 has a downwardly facing annular surface extending around the outer sheath 34. The upper portion 88 of the upper sleeve 84 has a conical recess with a diameter narrowing in the downward direction. At the base of the conical recess an annularly extending shoulder 90 faces upwardly.

A sealing arrangement is provided on the outer sheath in order to seal the chamber from the outside. The sealing arrangement comprises a pair of O-rings 78 and a pair of ring members 80 which extend round the outer sheath 34 of the intervention hose 2, as seen in further detail in FIG. 13. The ring members 80 have a substantially square cross-section as viewed in the radial direction of the ring members. An upper one of the ring members 80 engages an upper surface of an upper one of the O-rings 78, and a lower one of the ring members 80 engages an upper surface of a lower one of the O-rings 78. A pair of wedge members 82, each extending 180° circumferentially of the intervention hose 2, engages the outer sheath 34 and each wedge member 82 has a respective lower axial end face 83 for engagement with the upper one of the pair of ring members 80. During assembly, the wedge members 82 are placed around the outer sheath 34 and are urged downwardly by engagement of the closing plate 86 during bolting of that plate to the upper portion 88 of the upper sleeve 84. As a result, the lower axial end faces 83 of the wedge members 82 engage the upper ring member 80 and urge it downwardly. As the upper ring member 80 is urged downwardly, it pushes downwardly on the upper O-ring 78, which in turn pushes downwardly on the lower ring member 80, which in turn pushes downwardly on the lower O-ring 78. Since the lower O-ring 78 sits on the shoulder 90 of the upper portion 88 of the upper sleeve 84, it cannot move downwardly. The consequence therefore of urging the wedge members 82 downwardly is to compress the upper and lower O-rings 78 and create a seal between the outer sheath 34 of the intervention hose 2 and the inside wall of the conical recess of the upper portion 88 of the upper sleeve 84. Thus, the chamber 46 is sealed at its upper end from the outside.

At the lower end of the chamber 46 another sealing arrangement is provided to seal the chamber from the outside. The upper sleeve 84 terminates in a lower skirt 91, where it is bolted to the feed-through receptacle 52. A top portion of the feed-through receptacle is provided with a pair of O-rings 92, which provide the sealing arrangement at the lower end of the chamber 46 by sealing between the feed-through receptacle 52 and the lower skirt 91 of the upper sleeve 84 of the termination assembly 26.

The termination assembly 26 is connected in removable and sealed manner to the well logging tool 28. A pair of O-rings 94 is provided around the radially outer surface of a lower portion of the feed-through receptacle 52, and each O-ring 94 engages with a radially inner surface of an upper portion of the well logging tool 28. A connecting sleeve 96 on the lower portion of the feed-through receptacle 52 is formed with an internal thread 98 which mates with an external thread on an upper portion of the well logging tool (not shown). During assembly, once the respective twin ferrule connector assemblies at the interface between the termination assembly 26 and the well logging tool 28 are aligned and connected up, the connecting sleeve 96 is rotated relative to the lower portion of the feed-through receptacle 52 to cause the well logging tool 28 to advance upwardly without rotation relative to the termination assembly 26. Once the well logging tool and the termination assembly 26 are tightly engaged, the connecting sleeve 96 is locked in place using screws 98.

In a similar manner to the connection between the termination assembly 26 and the well logging tool 28, the well logging tool 28 is connected in a removable and sealed manner to the jetting tool 30, and the jetting tool 30 is connected in a removable and sealed manner to the drilling tool 32.

Figure 14:
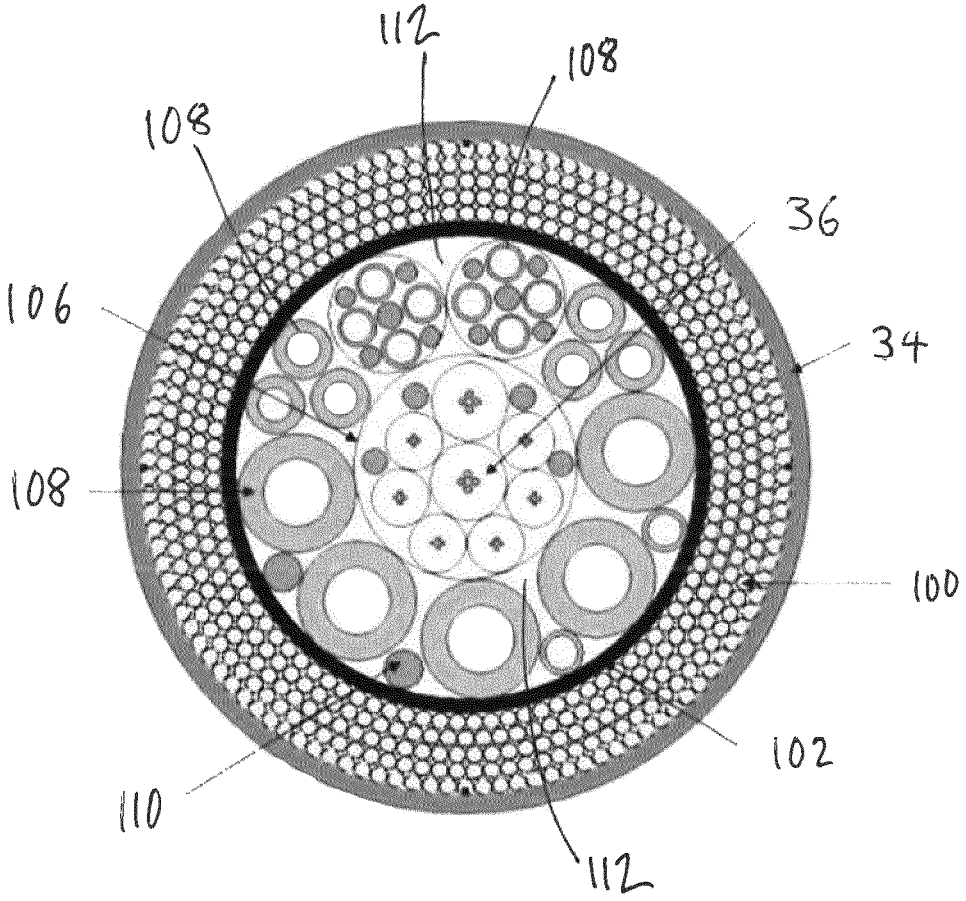
FIG. 14 shows an alternative embodiment of intervention hose.

FIG. 14 shows another embodiment of an intervention hose 2. In this embodiment there is provided radially inwardly of the outer sheath 34 a wire armor tube 100, which serves to provide the hose with tensile strength and to protect the internal individual tubes. An inner sheath 102 is provided radially inwardly of the wire armor tube 100, and inside the inner sheath 102 individual tubes are provided for electrical and fluid communication. Electrical cables 36 are provided at the core of the hose and are surrounded by binding tape 106. Three different diameter individual tubes 108 are provided for fluid communication, and filler members 110 are provided in some of the voids between the electrical cables 36, and also between the tubes 108. The filler members 110 provide a flexible material to provide lateral support to the individual tubes. The voids are further occupied by filler material 112 in the form of an injected resin or plastic, further assisting with lateral support.

The invention claimed is:

1. A well intervention apparatus comprising a flexible hose to be lowered into a well, a stuffing seal which engages around the hose during lowering, at least one tool provided at a downhole end portion of the hose, a plurality of individual tubes extending along an inside region of the hose and connecting to the at least one tool, each individual tube providing a fluid path for fluid communication between outside of the well and the at least one tool inside the well, and each individual tube being laterally supported in said inside region such that its lateral movement is restricted; and a bottom hole assembly disposed at the downhole end portion of the hose, said bottom hole assembly having a sealing arrangement that includes a seal disposed around the downhole end portion of the hose, and a pair of wedge members, each wedge member extending a circumferential distance around the hose, wherein the sealing arrangement is configured so that the wedge members compress the seal into sealing engagement with the hose.

2. The well intervention apparatus of claim 1, comprising a flexible material in the inside region to provide said lateral support to the individual tubes.

3. The well intervention apparatus of claim 1, wherein the bottom hole assembly comprises a termination assembly for the hose.

4. The well intervention apparatus of claim 3, wherein the hose extends into a body of the termination assembly, and the seal around the downhole end portion of the hose is provided in a cavity in the body of the termination assembly.

5. The well intervention apparatus of claim 4, wherein the seal is compressed between the outside of the hose and the body of the termination assembly, and wherein the body of the termination assembly extends circumferentially around the hose.

6. The well intervention apparatus of claim 5, wherein the pair of wedge members are axially movable and each wedge member is configured so that when the respective wedge member is moved axially towards the seal, the seal is caused to engage in sealing manner between the outside of the hose and the body.

7. The well intervention apparatus of claim 3, wherein the inside region of the hose is open to a chamber in the bottom hole assembly, the chamber being sealed from the outside.

8. The well intervention apparatus of claim 7, wherein the chamber is formed in the termination assembly of the bottom hole assembly, and wherein the chamber is sealed from above by the seal around the hose and sealed from below by a second seal.

9. The well intervention apparatus of claim 7, comprising a connector in said chamber for connecting a continuation tube to one of said individual tubes, the continuation tube extending to the at least one tool.

10. The well intervention apparatus of claim 3, wherein the termination assembly is removably connected to the at least one tool.

11. The well intervention apparatus of claim 1, comprising at least two tools at the downhole end portion of the hose, a said individual tube providing a fluid path for fluid communication between outside of the well and a first one of said at least two tools, and a said individual tube providing for fluid communication between outside of the well and a second one of said at least two tools.

12. The well intervention apparatus of claim 1, further comprising at least one second individual tube in the form of an electrical cable.

13. The well intervention apparatus of claim 1, wherein the sealing arrangement further comprises a second seal, a first ring member, and a second ring member;

wherein the first ring member is disposed between the wedge members and the second seal, and the second ring member is disposed between the second seal and the seal.

14. A method of well intervention comprising lowering a flexible hose into a well through a stuffing seal which engages around the hose during lowering, at least one tool being provided at a downhole end portion of the hose, and a plurality of individual tubes extending along an inside region of the hose and connecting to the at least one tool, each individual tube providing a fluid path for fluid communication between outside of the well and the at least one tool inside the well, and each individual tube being laterally supported in said inside region such that its lateral movement is restricted;

wherein the flexible hose includes a bottom hole assembly disposed at the downhole end portion of the hose, and the bottom hole assembly has a sealing arrangement that includes a seal disposed around the downhole end portion of the hose and a pair of wedge members, each wedge member extending a circumferential distance around the hose, wherein the sealing arrangement is configured so that the wedge members compress the seal into sealing engagement with the hose.

15. The method of claim 14, wherein flexible material is provided in the inside region of the hose to provide said lateral support to the individual tubes.

16. The method of claim 14, comprising carrying out a plurality of operations using the at least one tool.

17. The method of claim 16, comprising carrying out a first of said plurality of operations using a first one of said individual tubes for fluid communication, and carrying out a second of said plurality of operations using a second one of said individual tubes for fluid communication.

18. The method of claim 16, comprising lowering the flexible hose once to perform said plurality of operations using the at least one tool, and then raising the flexible hose.

19. The method of claim 14, wherein the well is a non-subsea well.

* * * * *